United States Patent [19]

Jarvis, Jr.

[11] 4,263,686

[45] Apr. 28, 1981

[54] FLOTATION JACKET

[75] Inventor: Lester G. Jarvis, Jr., Madison, Ga.

[73] Assignee: Wellington Puritan Mills, Inc., Madison, Ga.

[21] Appl. No.: 50,674

[22] Filed: Jun. 21, 1979

[51] Int. Cl.[3] ..... B63C 9/10

[52] U.S. Cl. ..... 9/341

[58] Field of Search ..... 9/329, 336–344

[56] References Cited

U.S. PATENT DOCUMENTS

| | | | |
|---|---|---|---|
| 657,156 | 9/1900 | Bickley | 9/344 X |
| 3,247,531 | 4/1966 | Baker | 9/338 |
| 3,261,042 | 7/1966 | Baker | 9/342 |
| 3,400,415 | 9/1968 | Scheurer | 9/342 |
| 3,736,610 | 6/1973 | Frieder, Jr. | 9/342 |
| 3,988,795 | 11/1976 | Robertson | 9/338 |
| 4,193,153 | 3/1980 | Tyrer et al. | 9/342 |

*Primary Examiner*—Sherman D. Basinger

*Attorney, Agent, or Firm*—Newton, Hopkins & Ormsby

[57] ABSTRACT

A flotation jacket or vest is unit molded from foam plastics to fit the body with comfort. Uncomfortable square cut edges are completely eliminated. The interior surface of the jacket is grooved to promote drainage and to help the jacket conform to body contours particularly in regions of abrupt curvature. Zones of increased thickness resulting in greater buoyancy can be formed near the bottom of the jacket. Quick release buckles at the front of the jacket are readily reachable at all times by the wearer.

11 Claims, 7 Drawing Figures

FLOTATION JACKET

BACKGROUND OF THE INVENTION

Traditionally, PVC foam flotation jackets or vests have been die stamped from a blank sheet of foam having a uniform thickness. By this method, all marginal edges of the jacket are square cut and tend to be uncomfortable to the wearer. Also, the die cut flotation jackets have a tendency to conform rather poorly to the body of the wearer and more easily buckle or wrinkle when worn by a water skier, again lessening the comfort of the jacket.

In light of the above, it is the objective of this invention to improve on the known prior art by providing a molded PVC foam flotation jacket or vest of significantly increased comfort due to the formation of smoothly rounded marginal edges and truer conformity of the molded jacket to the normal torso. Comfort and fit are also enhanced in the invention by molding a grooved or waffled interior surface on the jacket over its entire area. The grooves of this surface are of V-shape and can close up in regions of abrupt curvature on the torso so that the jacket can closely conform to the natural curves of the body. The waffled interior surface also promotes drainage as when a downed water skier is attempting to rise and wishes to rid himself quickly of as much weight as possible.

A further important advance realized by the invention as a result of the molding technique is the provision near the bottom of the jacket or vest of zones having increased wall thickness containing greater numbers of flotation cells for maximum buoyancy in the portions of the jacket which are most apt to be submerged in water. The flotation jacket or vest is also vinyl dipped to form a smooth tough skin on its outer surfaces.

Other features and advantages of the invention will become apparent during the course of the following detailed description.

DETAILED DESCRIPTION

Figure 3:
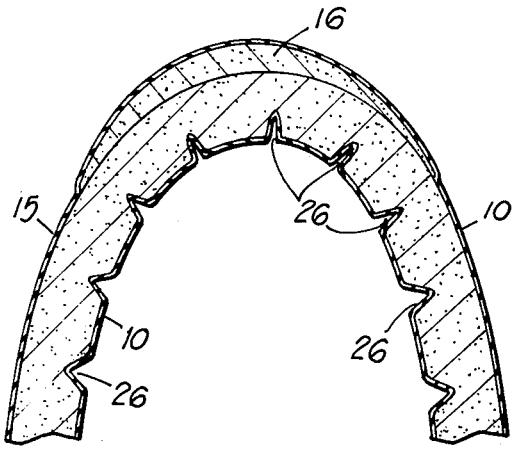
FIG. 3 is an enlarged fragmentary vertical section taken on line 3—3 of FIG. 2.
Figure 4:
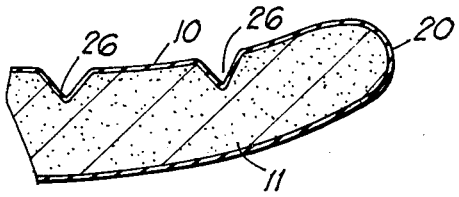
FIG. 4 is a fragmentary horizontal section taken on line 4—4 of FIG. 2.

Referring to the drawings in detail wherein like numerals designate like parts, FIGS. 1 through 4 show a flotation jacket which is unit molded from PVC foam and dipped in vinyl to form a smooth comparatively thin outer skin on the jacket as indicated at 10 in FIGS. 3 and 4. In the preferred embodiment of the invention as clearly shown in FIG. 1, the jacket or vest has open sides and includes a back wall 11 which is divided centrally at 12 from the lower edge 13 upwardly to a point near the vertical center of the jacket. This division promotes comfort and flexibility and forms two roughly rectangular rear flap portions on the jacket as viewed in FIG. 2.

Similarly, the flotation jacket has divided front torso walls 14 which lie opposite the divided back wall portions and are integrally joined thereto by comparatively narrow shoulder encircling curved sections 15 which may contain additional foam padding 16, as shown.

Figure 1:
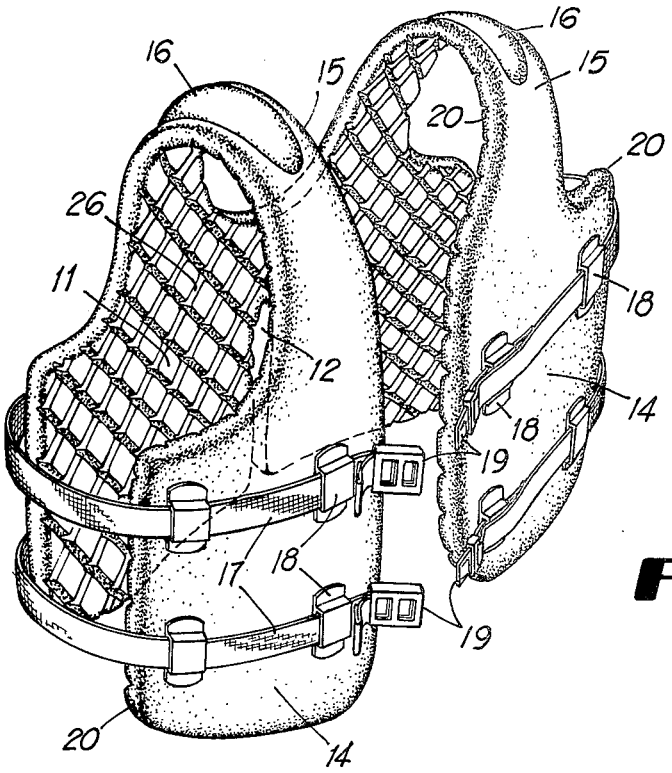
FIG. 1 is a perspective view of a flotation jacket according to one preferred embodiment of the invention.
Figure 2:
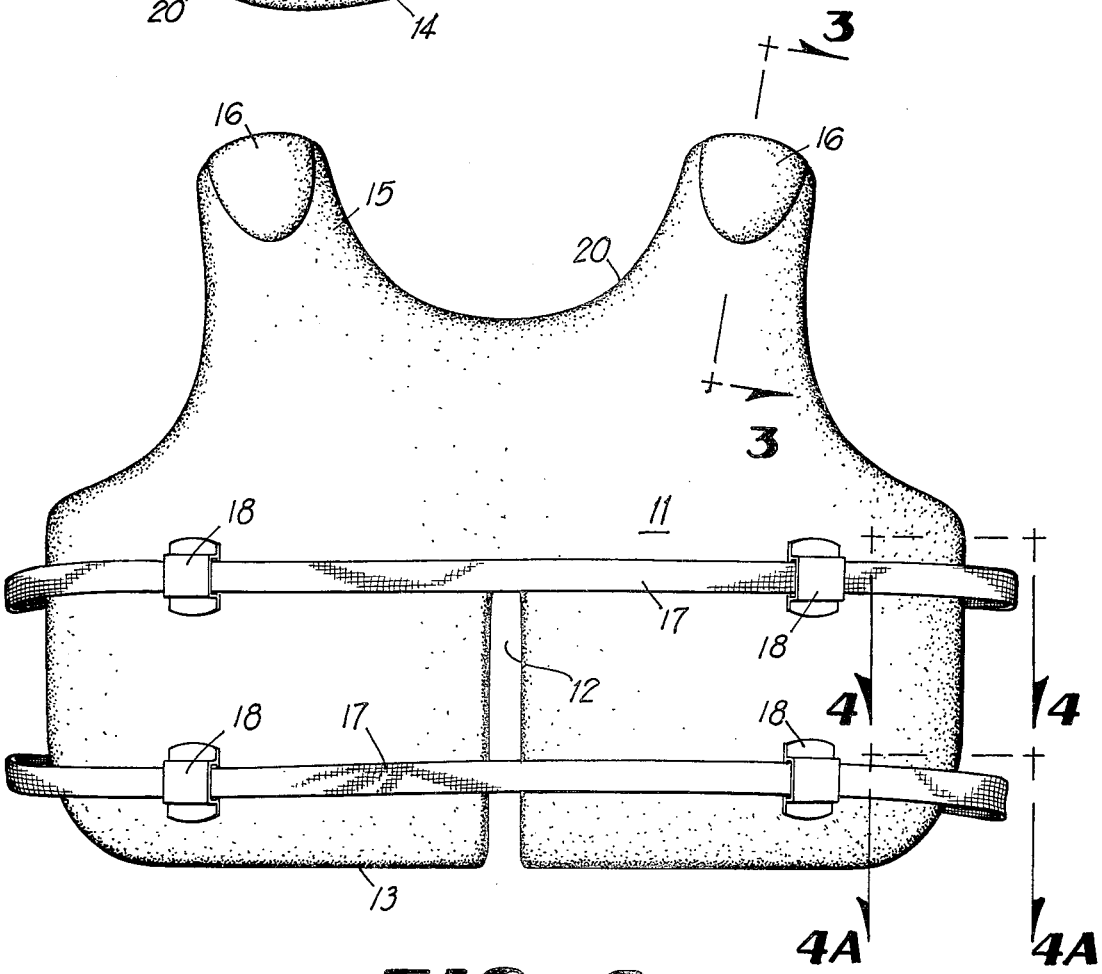
FIG. 2 is a rear elevation of the jacket in FIG. 1.

A pair of horizontal closure straps 17 for the garment are held and guided in loops 18 on the front and back thereof, the straps carrying quick release buckles 19 always in ready reach of the wearer at the front of the jacket, FIG. 1, due to the placement of pairs of the loops 18 close to the front parted edges of the jacket.

The molded jacket is shaped permanently in the molding process to conform to the natural contours of the human body in the interest of comfort and to reduce any tendency of the garment to buckle or wrinkle while being worn. The molding process also allows the formation of smoothly rounded marginal edges 20 on the garment with the complete absence of any square cut edges which are uncomfortable.

Figure 6:
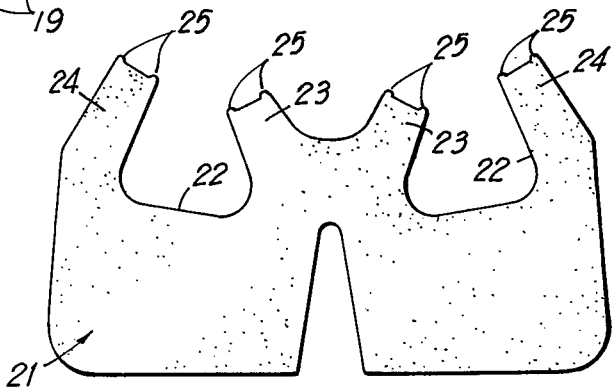
FIG 6 PRIOR ART
FIG. 6 is a fragmentary plan view showing the prior art.

In the customary prior art, FIG. 6, the jacket is produced from a die stamped uniform thickness blank 21 of PVC foam where all of the marginal edges of the blank are square or perpendicular to the opposite major surfaces of the blank. The die stamped blank 21 has arm openings 22 and shoulder portions formed by extensions 23 and 24 having small projections 25 which are joined to complete the shoulder sections of the finished jacket. Since the blank 21 is flat, it does not naturally conform to the contours of the body and has a greater tendency to buckle and wrinkle in the finished garment. This factor, together with the square cut marginal edges, renders the prior art garment much less comfortable than the garment in accordance with this invention.

A further important feature resides in molding a waffled surface 26 on the entire interior of the garment. The waffled surface additionally promotes comfort in that the grooves may close up at zones of abrupt curvature as at the shoulders, FIG. 3, so as to provide an almost continuous inner face in contact with the body, as shown. In regions of lesser curvature, the grooves 26 are more open, FIGS. 3, 4 and 4A. The net effect of the waffling is to allow the molded garment to conform more closely and more naturally to the body, again to increase comfort. A bonus feature derived from the grooves or waffling 26 is that they render the jacket more quickly drainable of water after the wearer, such as a water skier, has fallen and become submerged. The quick draining capability of the jacket enables the skier to rid himself of weight and arise more easily.

Figure 4A:
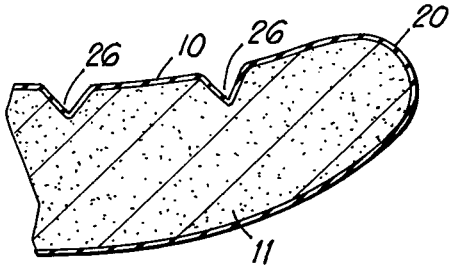
FIG. 4A is a fragmentary horizontal section taken on line 4A—4A of FIG. 2.

Still another improvement feature derived from the molding of the foam jacket is the provision near the bottom edge of the jacket and somewhat thereabove of regions having increased wall thickness and therefore greater numbers of flotation cells than the remainder of the garment. Such increased wall thickness is shown in FIGS. 4 and 4A. The degree of increased thickness at the bottom of the jacket may vary and may be included at both the front and rear of the jacket. This feature is optional and, if preferred, the wall thickness of the jacket may be uniform. The purpose of increasing the wall thickness of the garment near its bottom edge is to impart maximum buoyancy at this region which is more frequently submerged in the water.

Figure 5:
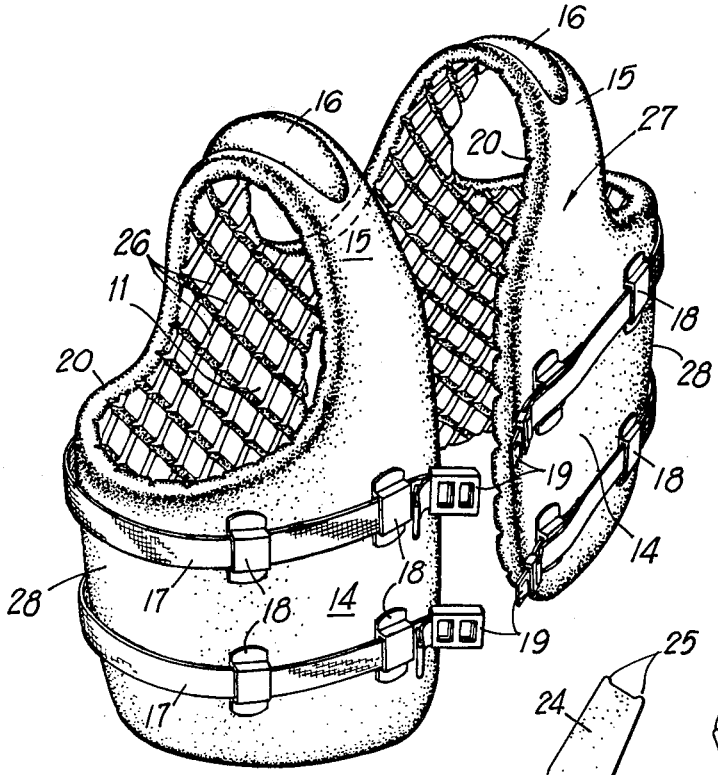
FIG. 5 is a perspective view of a flotation jacket according to a second embodiment.

FIG. 5 shows a second embodiment of the invention wherein the molded flotation jacket or vest 27 differs from the prior embodiment only in the fact that the garment has closed side walls 28 integrally joined with the rear wall 11 and the front torso walls 14. All other features remain exactly the same as to structure and function as in the prior embodiment shown in FIGS. 1 through 4.

The several features of the invention common to both embodiments which have been described interact to greatly increase the comfort of the flotation garment, to resist wrinkling and buckling, and to assure maximum buoyancy. All of these features are basically derived from the molding of the foam garment as distinguished from die cutting it as an initially flat blank. It is thought that the advantages of the invention over the prior art will now be apparent to those skilled in the art without the necessity for any further description.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A flotation jacket composed essentially of resilient foam plastics material comprising a permanently contoured member for conforming to the contour of the back, rib cage and shoulders of the human body, said jacket having its marginal edges rounded and having a smooth continuous outer surface and a grooved interior surface, said interior surface being provided with inwardly opening intersecting grooves therein, certain of which are deformed for being relatively narrow along concaved portions of said interior surface and certain other of which are relatively wide along flatter portions thereof to promote conformity to natural body curves, the grooves along the front and back portions of the jacket opening downwardly toward the lower edge of the jacket to promote drainage, and closure means for the jacket at the front of the jacket.

2. A flotation jacket as defined in claim 1, and the grooved interior surface having a waffle pattern.

3. A flotation jacket as defined in claim 1, and said jacket being open at its opposite sides, and said closure means comprising at least one strap encircling the jacket horizontally and across its open sides and having quick release fastener means at the front of the jacket.

4. A flotation jacket as defined in claim 1, and said jacket having a bottom edge and having a region of increased wall thickness near the bottom edge compared to the wall thickness of the remainder of the jacket to increase the buoyancy of the jacket near its bottom.

5. A flotation jacket as defined in claim 1, and said jacket having an outer thin non-cellular substantially smooth skin thereon.

6. A flotation jacket as defined in claim 5, and said foam plastics material being polyvinylchloride and said skin comprising a vinyl skin.

7. The flotation jacket defined in claim 1 wherein said grooves intersect each other for defining a waffled interior surfaces, said grooves along the surface of said back wall being straight and criss-crossed with respect to each other and extending angularly with respect to the bottom edge of said back wall.

8. A flotation jacket comprising a unitary molded plastic body having a back wall, a pair of opposed front torso walls, curved shoulder section for respectively passing over the shoulders of a person, the ends of said curved shoulder sections being connected to the upper edge portions of said back wall and connected respectively to the upper edge portion of said front torso walls, a pair of generally parallel straps encircling said front torso walls and said back wall, loops on said front torso walls and said back wall for supporting said straps, said straps terminating outwardly adjacent to the opposed edges of said front torso walls, buckles on the ends of said straps for coupling and releasing said straps, the outer edges of said back wall, said shoulder sections and said front torso walls being rounded, the inner surfaces of said back wall, said shoulder sections and said front torso wall being provided with intersecting grooves for defining waffled surfaces, the grooves defining the inner surfaces of said shoulder sections being more narrow than the grooves along said front torso walls and said back wall.

9. The flotation jacket defined in claim 8 wherein the side edges of said front torso walls are respectfully integrally joined to the side edges of said back wall.

10. The flotation jacket defined in claim 8 wherein the outer surface of said back wall and torso walls are smooth and said grooves are V-shaped and terminate spaced inwardly of the smooth outer surfaces of said back wall and said torso walls.

11. A flotation jacket comprising a jacket body molded as a unit from foam plastics material and being permanently contoured in the molding process to fit a human body of a particular size, the jacket body having shoulder covering portions, a back wall and side walls and also having a divided front wall, the jacket body having arm openings above said side walls, the jacket body having marginal edges which are rounded for comfort, the entire interior surface of the jacket body being deeply grooved with a waffle pattern to promote drainage and to promote conformity to body contours, the jacket body having an exterior skin of smooth non-cellular plastics material integrally bonded thereon, and front closure means for the jacket including straps which encircle the front, side and back walls of the jacket body.

* * * * *